US006801745B1

(12) United States Patent
Gogate et al.

(10) Patent No.: US 6,801,745 B1
(45) Date of Patent: Oct. 5, 2004

(54) FUSER FOR AN ELECTROPHOTOGRAPHIC PRINTER AND METHOD OF USING SAME

(75) Inventors: Hrishikesh P. Gogate, Lexington, KY (US); Calvin D. Murphy, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 10/401,014

(22) Filed: Mar. 27, 2003

(51) Int. Cl.[7] ..... G03G 15/20
(52) U.S. Cl. ..... 399/329; 219/216; 399/333
(58) Field of Search ..... 399/329, 328, 399/320, 330, 331, 333, 45, 68, 307, 309; 219/216, 388; 347/156

(56) References Cited

U.S. PATENT DOCUMENTS

| | | | | |
|---|---|---|---|---|
| 5,289,247 A | * | 2/1994 | Takano et al. | 399/68 |
| 5,303,016 A | | 4/1994 | Oda et al. | |
| 5,532,056 A | | 7/1996 | Satoh et al. | |
| 5,732,318 A | | 3/1998 | Natsuhara et al. | |
| 5,832,353 A | | 11/1998 | Sano | |
| 5,866,875 A | | 2/1999 | Okabayashi | |
| 5,918,099 A | | 6/1999 | Schlueter, Jr. et al. | |
| 6,010,791 A | | 1/2000 | Tan et al. | |
| 6,075,228 A | * | 6/2000 | Goto et al. | 219/216 |
| 6,090,305 A | | 7/2000 | Balch et al. | |
| 6,137,985 A | * | 10/2000 | Kinouchi et al. | 399/329 |
| 6,157,806 A | | 12/2000 | Elbert et al. | 399/329 |
| 6,198,902 B1 | | 3/2001 | Vaughan et al. | |
| 6,201,945 B1 | | 3/2001 | Schlueter, Jr. et al. | |
| 6,272,309 B1 | * | 8/2001 | Kitazawa et al. | 399/333 |
| 6,298,216 B1 | | 10/2001 | McMindes et al. | |
| 6,321,061 B1 | | 11/2001 | Sonobe et al. | |
| 6,577,840 B2 | * | 6/2003 | Hachisuka et al. | 399/329 |
| 2001/0019676 A1 | | 9/2001 | Okuba et al. | |
| 2001/0019677 A1 | | 9/2001 | Ishizaki et al. | |
| 2002/0044801 A1 | * | 4/2002 | Omata et al. | 399/309 |
| 2002/0057934 A1 | | 5/2002 | Ishikawa et al. | |

FOREIGN PATENT DOCUMENTS

| | | | |
|---|---|---|---|
| JP | 10-104979 | * | 4/1998 |
| JP | 10-228190 | * | 8/1998 |
| JP | 2001-201979 | * | 7/2001 |

* cited by examiner

*Primary Examiner*—Sophia S. Chen
(74) *Attorney, Agent, or Firm*—Taylor & Aust, P.C.

(57) ABSTRACT

A fuser for fusing an image to a toner side of a print medium in an electrophotographic printer. The fuser includes an endless belt defining an inner loop. A heater is positioned in contact with the belt within the inner loop. A pressure roller defines a nip with the belt and is positioned adjacent the toner side of the print medium.

19 Claims, 1 Drawing Sheet

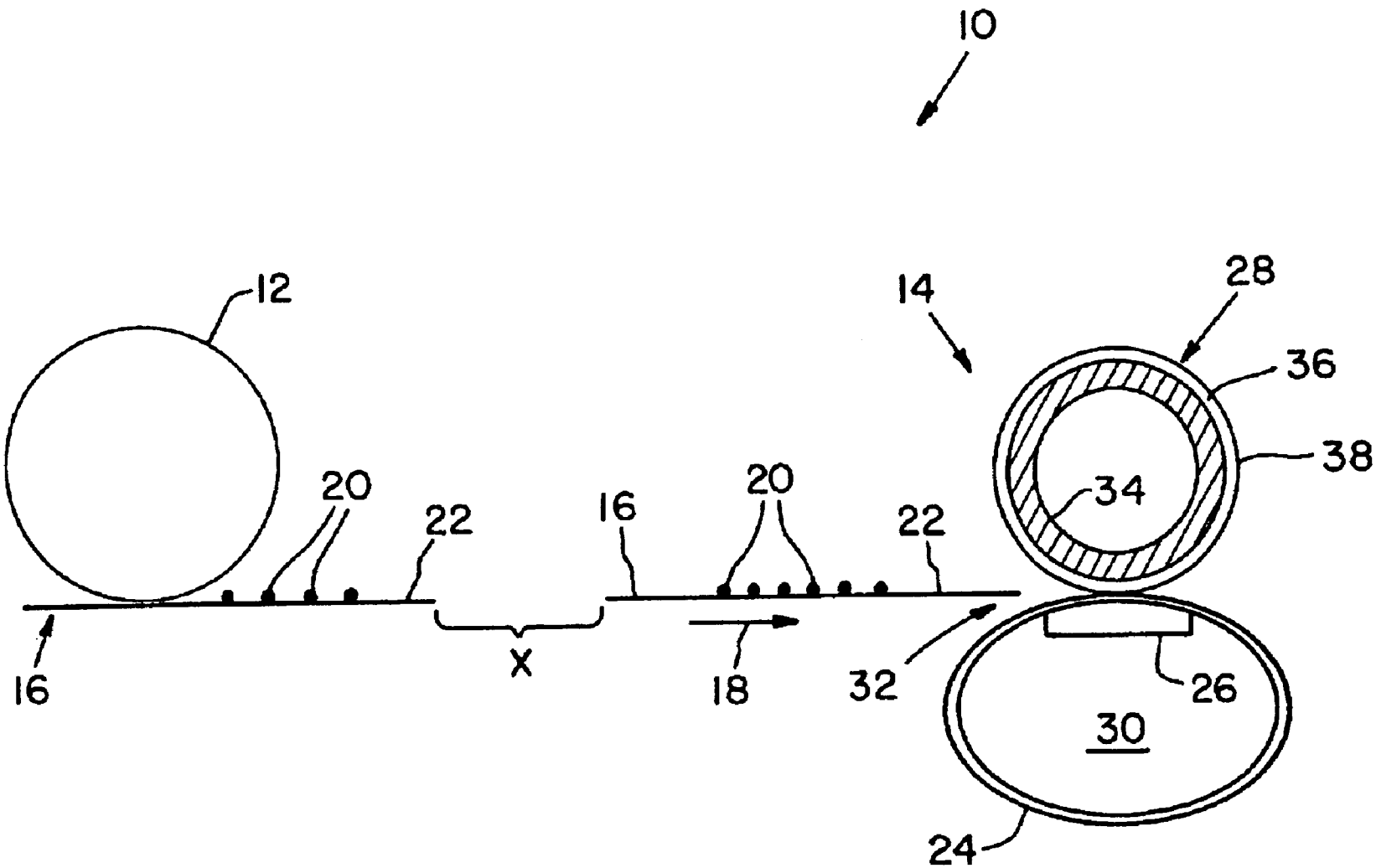
10
14
28
36
38
34
26
30
24
32
22
20
18
16
X
22
20
12
16

FUSER FOR AN ELECTROPHOTOGRAPHIC PRINTER AND METHOD OF USING SAME

BACKGROUND OF THE INVENTION

1. Field of the Invention

The present invention relates to electrophotographic printers, and, more particularly, to fusers in electrophotographic printers.

2. Description of the Related Art

In an electrophotographic (EP) printer, unfused toner particles are electrostatically attracted to the media to form an image. In order for the image to be fixed permanently the media must be fused. By combination of high temperature and pressure the toner is melted and forced to adhere to the media.

In color printing the fusing requirement is more stringent than merely ensuring that the toner adheres to the media. As there are multiple layers of toner, more energy is required to fuse the toner. Sufficient energy must be added to the media and toner such that the toner becomes transparent. The ability to mix colors and the ability to produce good quality transparencies depends on the ability to make the toner transparent. The trend in current printer technology has been to attempt to reduce standby power requirements and reduce warm up times for the fuser. For this reason a belt and a ceramic heater fuser is highly desirable. Due to the low thermal mass of such a fuser it has a very short warm up time, and no standby mode is required. This type of fuser has been used in several monochromatic printing applications. However, this type of fuser has not been successfully implemented for a color printing application. Color fusers have to fuse a much higher toner mass/area ratio. The higher coverage presents two challenges; first that all the layers of toners must be adequately fused and second that the fused toner must release cleanly from the belt surface. Color prints and especially transparencies are more sensitive to print quality defects than mono prints. Most color fusers therefore are compliant hot roll fusers, which are expensive and slow to warm up.

The type of belt used for mono fusers typically has a polyimide layer of 50–60 microns and a top coat of either spray coated or dip coated polytetraflouroethylene (PTFE), perfluoroalkoxy (PFA), or polytetrafluoroethylene-perfluoromethyl vinyl ether (MFA). MFA is the trade name for a modified PFA made by Ausimont USA Inc. (now Solvay Solexis), which has lower molecular weight and also a lower melting point than PFA. The coating of PTFE does not release cleanly at the level of mass/area required for color printing. Normally in a hot roll fuser a PFA sleeve is used to get the necessary release properties. Also the polymide belt lacks compliance and thus cannot conform well to the toner pile height variation and there is no "kneading" of the toner as there would be with a compliant hot roll. A belt with a rubber layer and a PFA sleeve may be adequate to fuse color prints but such a belt is difficult to manufacture and expensive. Moreover by adding the rubber layer one negates the fast warm up time advantage for the belt fuser. The belt fuser has yet another limitation in that the nip pressure tends to be low compared to hot roll fusers. Since the belt has to slide relative to the heater housing the friction between the belt and other components must be minimized. Thus the force applied to the nip is limited also.

A color fuser may include a pressure roller with a heater positioned within the roller. The heater thus heats the roller from the inside out. Since the outer periphery of the pressure roller is used during the fusing process, the warm up time of the roller is the time necessary for the roller to transfer heat to the outside periphery of the roller where work is performed. This results in a slow warm up time of the color fuser.

What is needed in the art is an electrophotographic printer with a fuser having both a fast warm up time and sufficient thermal mass to fuse color images.

SUMMARY OF THE INVENTION

The present invention provides a fuser which externally heats a pressure roller through conduction heat transfer from a heater positioned within an endless belt.

The invention comprises, in one form thereof, a fuser for fusing an image to a toner side of a print medium in an electrophotographic printer. The fuser includes an endless belt defining an inner loop. A heater is positioned in contact with the belt within the inner loop. A pressure roller defines a nip with the belt and is positioned adjacent the toner side of the print medium.

The invention comprises, in another form thereof, a method of fusing toner particles to a print medium in an electrophotographic printer, including the steps of: energizing a heater within an inner loop of an endless belt; transferring heat via conduction from the heater, through the belt, and to a pressure roller against the belt; transporting the print medium through a nip defined between the belt and the pressure roller such that the toner particles are in contact with the pressure roller; and fusing the toner particles to the print medium using heat from the pressure roller.

An advantage of the present invention is that the pressure roller is heated externally (from the outside periphery) to reduce warm up times.

Another advantage is that the pressure roller has a higher thermal mass to fuse images with a higher toner density.

Yet another advantage is that the pressure roller has good compliance and release properties using a multi-layer configuration.

A further advantage is that the endless belt has a lower thermal mass to heat up quickly.

Still another advantage is that the thin belt allows heat to be transferred effectively and quickly via conduction to the pressure roller.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawing, which is a schematic illustration of an embodiment of a fuser of the present invention.

The exemplification set out herein illustrates one preferred embodiment of the invention, in one form, and such exemplification is not to be construed as limiting the scope of the invention in any manner.

DETAILED DESCRIPTION OF THE INVENTION

Referring now to the sole FIGURE, there is shown a schematic illustration of a portion of an EP printer 10 of the present invention. EP printer 10 includes a photoconductive (PC) member 12, a fuser 14, and a paper feed assembly (not specifically shown) which moves print media 16 through EP printer 10. In the embodiment shown, PC member 12 is in the form of a PC drum, but may also be in the form of a PC belt or the like. Further, in the embodiment shown, print media 16 is in the form of paper, but may also be in the form of a transparency, card stock, etc. The paper feed assembly moves print media 16 in an advance direction through EP printer 10, as indicated by arrow 18. Print media 16 are separated by an inter-page gap X which may be a constant or variable distance.

Fuser 14 fuses toner particles 20 defining an image to a toner side 22 of each print medium 16. Toner particles 20 may be monochrome particles transferred to print medium 16 from PC drum 12, or may be different colors of particles (e.g., cyan, magenta, yellow and/or black particles) deposited on print medium 16 from multiple PC drums 12 or PC members of a different type.

Fuser 14 includes an endless belt 24, heater 26 and pressure roller 28. Belt 24 defines an inner loop 30. In the embodiment shown, belt 24 is a polyimide belt having a thickness of between approximately 40 to 70 microns, preferably having a thickness of 50 to 60 microns. Belt 24 also preferably is coated with a release coating such as a spray coated or dip coated PTFE, PFA, or MFA. Polyimide belt 24 has a low thermal mass and is thin enough so that heat is readily transferred therethrough from heater 26. Belt 24 may include a boron nitride or other filler to enhance thermal conductivity.

Heater 26 is positioned within inner loop 30 and in direct contact with belt 24. Heater 26 has a profile (e.g., flat or curved) generally corresponding to the travel path of belt 24 to provide an area contact rather than a line contact for more efficient thermal transfer. In the embodiment shown, heater 26 is in the form of a ceramic heater positioned within inner loop 30 and against belt 24.

Pressure roller 28 defines a nip 32 with belt 24, through which print medium 16 travels. Pressure roller 28 is positioned adjacent toner side 22 of print medium 16 as print medium 16 is transported through nip 32.

Pressure roller 28 has a thermal mass which is sufficient to store thermal energy received from heater 26. Pressure roller 28 has a thermal mass which is substantially greater than a thermal mass of belt 24. In the embodiment shown, pressure roller 28 includes a metal core 34, a compliant layer 36 surrounding core 34, and a release layer 38 surrounding compliant layer 36. Metal core 34 is formed from a suitable metal which provides structural rigidity and stores thermal energy, such as aluminum or steel. Compliant layer 36 is formed from a material providing compliance of pressure roller 28, dependent upon surface irregularities of print medium 16 and the pile height of toner particles 20 passing through nip 32. In the embodiment shown, compliant layer 36 is in the form of silicon rubber, but may be formed of other resilient materials. Additionally, in the embodiment shown, release layer 38 is in the form of a PFA sleeve, but may also be formed from a different material providing suitable release properties from toner particles 20.

During printing, fuser 14 fuses toner particles 20 to toner side 22 of print medium 16. Heater 26 positioned within inner loop 30 of endless belt 24 is energized such that heater 26 provides a desired heat output. Heat is transferred principally via conduction from heater 26, through belt 24, and to the outer periphery of pressure roller 28. The outer periphery of pressure roller 28 is heated first, and this is also the surface which transfers heat to toner particles 20 for fusing an image on print medium 16. This results in a faster heat up time of pressure roller 22. Print medium 16 is transported through nip 32 between pressure roller 28 and belt 24. Heat is transferred from pressure roller 28 to toner particles 20 to fuse the image on print medium 16, and is additionally transferred to the backside of print medium 16 from heater 26 and belt 24 to assist in the fusing process. The varying thickness of toner particles on print medium 16 is accommodated by compliant layer 36. Print medium 16 releases from pressure roller 38 on the discharge side of nip 32 as a result of release layer 38 on the outer periphery of pressure roller 28. Dependent upon the media type, media length, number of pages printed continuously, or a print medium with a high density of toner particles, the interpage gap X may be increased to provide a longer warm up time for pressure roller 28.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An electrophotographic printer for printing on a print medium, comprising:

a photoconductive member; and a fuser for fusing an image to a toner side of the print medium, said fuser comprising:

an endless belt defining an inner loop;

a heater positioned in contact with said belt within said inner loop; and a pressure roller defining a nip with said belt and positioned adjacent the toner side of the print medium, said pressure roller having a thermal mass which is greater than a thermal mass of said belt.

2. The electrophotographic printer of claim 1, wherein said pressure roller includes a metal core, a compliant layer surrounding said core, and a release layer surrounding said compliant layer.

3. The electrophotographic printer of claim 2, wherein said compliant layer is comprised of silicon rubber, and said release layer is comprised of polyphenylene alkoxy ether.

4. The electrophotographic printer of claim 1, wherein said heater comprises a ceramic heater.

5. The electrophotographic printer of claim 1, wherein said belt comprises a polyimide belt.

6. The electrophotographic printer of claim 5, wherein said belt includes a polyimide layer of between approximately 40 to 70 microns.

7. The electrophotographic printer of claim 6, wherein said belt includes a polyimide layer of between approximately 50 to 60 microns.

8. The electrophotographic printer of claim 6, wherein said belt has a release coating.

9. A fuser for fusing an image to a toner side of a print medium in an electrophotographic printer, said fuser comprising:

an endless belt defining an inner loop;

a heater positioned in contact with said belt within said inner loop; and a pressure roller defining a nip with said belt and positioned adjacent the toner side of the print medium, said pressure roller having a thermal mass which is greater than a thermal mass of said belt.

10. The fuser of claim 9, wherein said pressure roller includes a metal core, a compliant layer surrounding said core, and a release layer surrounding said compliant layer.

11. The fuser of claim 10, wherein said compliant layer is comprised of silicon rubber, and said release layer is comprised of polyphenylene alkoxy ether.

12. The fuser of claim 9, wherein said heater comprises a ceramic heater.

13. The fuser of claim 9, wherein said belt comprises a polyimide belt.

14. The fuser of claim 13, wherein said belt includes a polyimide layer of between approximately 40 to 70 microns.

15. The fuser of claim 14, wherein said belt includes a polyimide layer of between approximately 50 to 60 microns.

16. The fuser of claim 14, wherein said belt has a release coating.

17. A method of fusing toner particles to a print medium in an electrophotographic printer, comprising the steps of:

energizing a heater within an inner loop of an endless belt;

transferring heat via conduction from said heater, through said belt, and to a pressure roller against said belt;

transporting the print medium through a nip defined between said belt and said pressure roller such that the toner particles are in contact with said pressure roller; and fusing the toner particles to the print medium using heat from said pressure roller.

18. The method of fusing of claim 17, including the step of varying an interpage gap between adjacent print media.

19. The method of fusing of claim 17, wherein said fusing step includes using heat from said heater and said belt.

* * * * *